US008177332B2

(12) United States Patent
Thompson et al.

(10) Patent No.: US 8,177,332 B2
(45) Date of Patent: May 15, 2012

(54) METHOD AND APPARATUS FOR FIXING A RADIATION-CURABLE GEL-INK IMAGE ONTO A SUBSTRATE

(75) Inventors: Michael D Thompson, Rochester, NY (US); Steven E Ready, Los Altos, CA (US); Gregory J Kovacs, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 607 days.

(21) Appl. No.: 12/352,620

(22) Filed: Jan. 13, 2009

(65) Prior Publication Data

US 2010/0177151 A1 Jul. 15, 2010

(51) Int. Cl.
*B41J 2/14* (2006.01)
*B41J 2/16* (2006.01)
*B41J 2/01* (2006.01)

(52) U.S. Cl. ..... 347/51; 347/101; 347/102; 347/103

(58) Field of Classification Search ..... 347/51, 347/102

See application file for complete search history.

(56) References Cited

U.S. PATENT DOCUMENTS 4,297,045 A 10/1981 Burton et al.
5,958,169 A 9/1999 Titterington et al.
6,365,280 B1 * 4/2002 Schlueter et al. ..... 428/447
2006/0066703 A1 * 3/2006 Kadomatsu et al. ..... 347/102
2007/0120930 A1 * 5/2007 Domoto et al. ..... 347/102
2008/0122914 A1 5/2008 Toma et al.
2009/0237479 A1 * 9/2009 Yamashita et al. ..... 347/103
2010/0103235 A1 * 4/2010 Roof et al. ..... 347/102
2010/0128096 A1 * 5/2010 Daniel et al. ..... 347/102

OTHER PUBLICATIONS

U.S. Appl. No. 12/256,670, filed Oct. 23, 2008; Roof et al; Method and Apparatus for Fixing a Radiation-curable Gel-ink Image on a Substrate.
Acrylite® OP-4 Acrylic Sheet, Technical Data, Ultraviolet-Transmitting Acrylic Sheet, pp. 1-4, CYRO Industries, Parsippany, NJ.
European Search Report Issued Apr. 27, 2010, in Connection with Related European Application No. EP 10 15 0181.

* cited by examiner

*Primary Examiner* — Ryan Lepisto
(74) *Attorney, Agent, or Firm* — Ronald E. Prass, Jr.; Prass LLP

(57) ABSTRACT

An apparatus prints and/or fixes ink on a substrate, such as in ink-jet printing with UV-curable inks. A conformable member is positioned to contact an ink-bearing side of the substrate at a nip. The conformable member substantially comprises a silicone-based elastomer having a conformability from about 20 shore A to about 10 shore A. A radiation source directs radiation to the ink-bearing side of the substrate at the nip, the radiation suitable for curing the ink on the substrate. The apparatus is particularly useful for printing onto corrugated cardboard or otherwise non-planar surfaces, since the resulting ink image is impressed uniformly onto the substrate by the conformable member without voids in the ink layer in the recesses of the non-planar surface.

20 Claims, 2 Drawing Sheets

METHOD AND APPARATUS FOR FIXING A RADIATION-CURABLE GEL-INK IMAGE ONTO A SUBSTRATE

CROSS-REFERENCE TO RELATED APPLICATIONS

Cross-reference is hereby made to the following US Patent Applications, assigned to the assignee hereof: U.S. application Ser. No. 12/256,670, filed Oct. 23, 2008; and U.S. application Ser. No. 11/291,284, filed Nov. 30, 2005, now US Patent Application Publication US 2007/0120930 A1.

INCORPORATION BY REFERENCE

The following documents are incorporated by reference in their entireties for the teachings therein: US Patent Application Publication US 2007/0120930 A1; and US Patent Application Publication US 2008/0122914 A1.

TECHNICAL FIELD

The present disclosure relates to printing with radiation-curable inks.

BACKGROUND

US Patent Application Publication US 2008/0122914 A1 discloses compositions for an ultraviolet (UV)-curable ink suitable for use in ink-jet printing. Such inks include one or more co-monomers and a gellant. When exposed to radiation of a predetermined frequency, these co-monomers polymerize and thus bind to any number of types of surfaces. In practical applications, such inks have a viscous property at room temperature, but become more liquid when heated for jetting onto a substrate to form images.

US Patent Application Publication US 2007/0120930 A1 discloses a printing apparatus suitable for use with a radiation-curable ink. The apparatus uses a "transfuse" system, wherein ink forming the desired image is first jetted onto an image receptor in the form of a belt, and then transferred from the image receptor onto a print sheet or other substrate. At various locations along the belt path are disposed ultraviolet radiation sources for partially hardening the ink on the belt before transferring to the print sheet.

In one application of UV-curable inks, it is desired to print on relatively non-planar surfaces, such as of the outer layer of corrugated cardboard for packaging purposes.

SUMMARY

According to one aspect, there is provided an apparatus useful in printing and/or fixing an image onto a substrate. A conformable member is positioned to contact an image-bearing side of the substrate at a nip. The conformable member is effectively transmissive of UV radiation, and substantially comprises a silicone-based elastomer having a conformability from about 20 shore A to about 10 shore A. A first radiation source is positioned to direct UV radiation to the ink-bearing side of the substrate at the nip, the radiation suitable for curing the ink on the substrate.

According to another aspect, there is provided a method useful in printing and/or fixing an image onto a substrate. A conformable member contacts an ink-bearing side of the substrate, the conformable member being effectively transmissive of UV radiation, and substantially comprising a silicone-based elastomer having a conformability from about 20 shore A to about 10 shore A. UV radiation is directed through the conformable member to the ink-bearing side of the substrate, the radiation suitable for curing the ink on the substrate.

DETAILED DESCRIPTION

Figure 1:
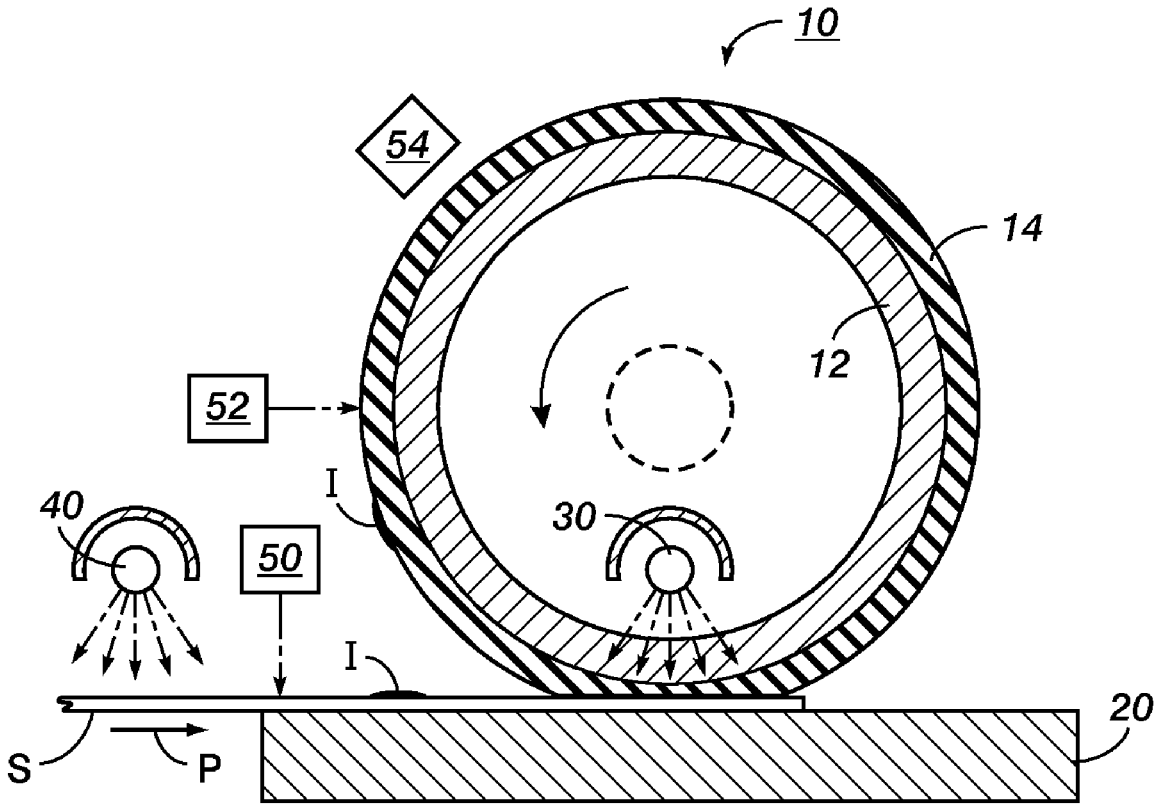
FIG. 1 is a simplified elevational view of a printing and/or fixing apparatus, as would be found in a larger printing apparatus, according to first embodiments.

FIG. 1 is a simplified elevational view of a printing and/or fixing apparatus, as would be found in a larger printing apparatus, according to first embodiments. A sheet or substrate (of any suitable material) S bearing an unfixed ink image I approaches, along a process direction P, a fixing apparatus including a rotatable member, here in the form of an ink-side leveling roller 10, and a backing member 20 (in alternative embodiments, the backing member can be in the form of a roller). In a practical embodiment, the ink image I comprises at this time an uncured, viscous liquid that has not significantly penetrated into the substrate S. At the nip formed between rollers 10 and 20, the unfixed ink I is mechanically "leveled" by the nip pressure, which effectively causes the various layers of multi-colored inks to assume a consistent total height relative to the surface of substrate S.

Simultaneous with the mechanical pressure applied at the nip, radiant energy is applied to the ink I, the radiant energy including suitable wavelengths, typically UV, for chemical curing of the ink I on substrate S as any small area of substrate S passes through the nip. For this purpose there is disposed within leveling roller 10 a radiation source 30, which may include for this embodiment one or more UV lamps or a UV-emitting LED array, directing radiation to the ink I in the nip as the substrate S moves therethrough. The power of source 30 or multiple sources is such that the ink I is fully cured by the time it leaves the nip for a given process speed. In such an embodiment, the walls of leveling roller 10 are effectively transmissive of the curing radiation, so the radiation can efficiently reach the ink I in the nip.

With particular reference to the structure of leveling roller 10, in this embodiment leveling roller 10 comprises a substantially rigid inner drum 12, and an outer conformable layer 14. Conformable layer 14 thus forms a "conformable member" presenting a conformable surface to substrate S, suitable for fixing ink I on a non-planar substrate S. According to possible embodiments, inner layer 12 comprises quartz with thickness of about 3 mm to about 13 mm, while conformable layer 14 substantially comprises a silicone-based elastomer having a conformability from about 20 shore A to about 10 shore A. A thickness of this material of about 1 mm to about 5 mm is suitable for its effective transmissivity of UV radiation. This material also provides a suitably low-friction surface for contact with the substrate S.

A printing or fixing station as described is useful in printing images on the outer surface of corrugated cardboard as is familiar in packaging material. Even though such an outer surface is basically smooth, the underlying corrugated layer at the core of the structure tends to create "waviness" in the outer surface. In commercially-available types of corrugated cardboard, the most commonly used flutes are called B flute, C flute and E flute. The relevant dimensions are as follows: for B flute, the wavelength is nominally ¼"; the measured amplitude of the outer surface waviness is about 0.060 mm, resulting in a peak-to-peak depth range on the outer surface of about 0.120 mm. For C flute, the wavelength is nominally 5/16"; the measured amplitude of the outer surface waviness is about 0.049 mm, resulting in a peak-to-peak depth range on the outer surface of about 0.098 mm. For E flute, the wavelength is nominally 1/8"; the measured amplitude of the outer surface waviness is about 0.037 mm, resulting in a peak-to-peak depth range on the outer surface of about 0.074 mm. Since the leveling roller 10 is conformable to a corrugated or otherwise non-planar surface, the printed ink layer uniformly covers the wavy outer surface of corrugated cardboard without voids in the ink layer in the recesses of the non-planar surface.

As shown in FIG. 1, the ink for printing can be placed on substrate S either directly, as shown by printhead 50 directing ink I onto substrate S upstream of roller 10; or alternatively the ink I can be placed directly on roller 10, such as by printhead 52. A system using printhead 52 is useful for architectures wherein an image is built up in several rotations of roller 10 before transfer to a substrate S. Such a system can also be useful in single pass architectures wherein, after being jetted onto the drum by printhead 52, the ink is immediately transferred to substrate S. In this architecture the smooth surface of a conformable material at a controlled, constant distance from the printhead can enable a high quality image to be printed. This image can then be transferred to a non-planar corrugated surface by the conformable material at much higher quality than would have been possible by jetting the image directly onto the corrugated surface. A temperature sensor 54 of known type can measure the surface temperature of leveling roller 10 just upstream of the nip, the recorded temperature being useful for a control system.

Also shown in FIG. 1 are IR lamps 40, or similar radiation-emitting devices, for pre-heating a substrate S as needed given a particular material set (ink and substrate). Such a lamp could be disposed upstream or downstream of a printhead 50, depending on a given design; and could emit UV light as part of a "tacking" or partial curing step in the printing process.

In the present embodiment, the curing of ink I is simultaneous with the mechanical pressure formed at the nip so that sufficient cross linking of monomers in the ink is initiated while still under a leveling condition such that polymerization is substantially complete by the time the image I leaves the nip formed by roller 10 and backing member 20. The process of polymerization results in a solid durable material that experiences some shrinkage. The shrinkage and hardness combined with the low surface energy layer on roller 10 lead to a condition whereby the image tends to self strip from the roller 10.

Figure 2:
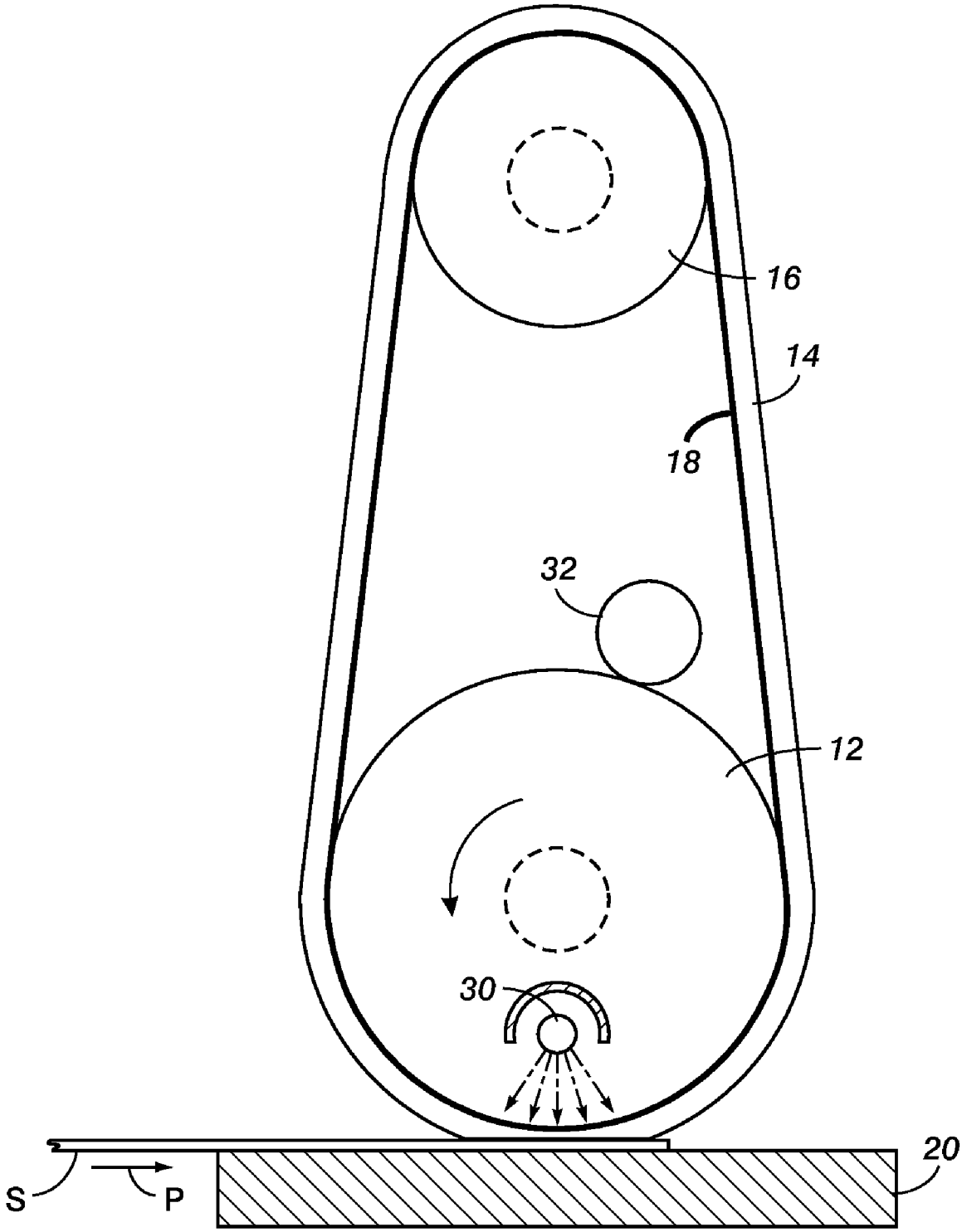
FIG. 2 is a simplified elevational view of a printing and/or fixing apparatus according to second embodiments.

FIG. 2 is an elevational view showing some elements of an alternative embodiment. In FIG. 1 and FIG. 2, like numbers indicate like elements. In the FIG. 2 embodiment, conformable layer 14 is detached from rigid inner drum 12, and a portion thereof is entrained around second roller 16. Inner drum 12 includes the UV lamp 30 therein. Depending on a specific design, inner drum 12 can be rotatable or stationary, in which case the conformable layer 14 is driven by second roller 16 and slides against drum 12. In the embodiment, conformable layer 14 has attached on the inner surface thereof a durable backing layer 18, such as ACRYLITE OP-4, an ultraviolet transmitting acrylic sheet material made by CYRO Industries. This embodiment can facilitate alternate systems for applying heat as needed to the ink or substrate, such as by use of a heating roll 32 (having thermal-generative portions, not shown, which may be placed in contact with inner drum 12 or conformable layer 14 as needed.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An apparatus useful in printing on a substrate, comprising:

a conformable member, positioned to contact an ink-bearing side of the substrate at a nip, the conformable member being effectively transmissive of UV radiation, and substantially comprising a silicone-based elastomer having a conformability from about 20 shore A to about 10 shore A the conformable member being configured to conform to a surface of a substrate that is non-planar whereby voids in an ink layer on the ink-bearing side of the substrate are minimized; and a first radiation source, positioned to direct UV radiation to the ink-bearing side of the substrate at the nip, the radiation suitable for curing the ink on the substrate.

2. The apparatus of claim 1, the conformable member having a thickness of about 1 mm to about 5 mm.

3. The apparatus of claim 1, the conformable member being rotatable, and the first radiation source being substantially disposed within the conformable member.

4. The apparatus of claim 3, the conformable member having attached thereto an acrylic layer.

5. The apparatus of claim 3, further comprising an inner drum disposed within the rotatable conformable member, the first radiation source being substantially disposed within the inner drum.

6. The apparatus of claim 5, wherein the inner drum is rigid.

7. The apparatus of claim 6, wherein the conformable member is attached to the inner drum.

8. The apparatus of claim 6, wherein the conformable member is not attached to the inner drum.

9. The apparatus of claim 8, wherein the inner drum is stationary and a roller drives the conformable member.

10. The apparatus of claim 1, further comprising a printhead for placing ink on the substrate.

11. The apparatus of claim 1, further comprising a printhead for placing ink on the conformable member.

12. The apparatus of claim 1, further comprising a second radiation source, the second radiation source directing radiation to the substrate before the first radiation source along a process direction of the substrate.

13. A method of printing on a substrate, comprising:

a conformable member contacting an ink-bearing side of the substrate, the conformable member being effectively transmissive of UV radiation, and substantially comprising a silicone-based elastomer having a conformability from about 20 shore A to about 10 shore A, the conformable member being configured to conform to a substrate that is non-planar whereby voids in an ink layer on the ink-bearing side of the non-planar substrate are minimized during printing; and directing UV radiation through the conformable member to the ink-bearing side of the substrate, the radiation suitable for curing the ink on the substrate.

14. The method of claim 13, the conformable member having a thickness of about 1 mm to about 5 mm.

15. The method of claim 13, further comprising placing ink on the substrate.

16. The method of claim 13, further comprising placing ink on the conformable member.

17. The method of claim 13, further comprising directing radiation to the substrate before directing UV radiation through the conformable member to the ink-bearing side of the substrate.

18. The method of claim 13, wherein the non-planar substrate defines a waviness having a wavelength of about ⅛" to about ¼" to about 5/16" and a peak-to-peak depth range of about 0.074 mm to about 0.120 mm to about 0.098 mm.

19. The method of claim 13, wherein the substrate comprises cardboard.

20. The method of claim 13, wherein the conformable member contacting the substrate prevents voids in an ink layer on a substrate surface.

* * * * *